US012655735B2

(12) United States Patent
You et al.

(10) Patent No.: US 12,655,735 B2
(45) Date of Patent: Jun. 16, 2026

(54) SHALE GAS FORMATION OXIDATION INDUCED ROCK BURST STIMULATION METHOD

(71) Applicant: Southwestern Petroleum University, Chengdu (CN)

(72) Inventors: Lijun You, Chengdu (CN); Rui Qian, Chengdu (CN); Qiuyang Cheng, Chengdu (CN); Yili Kang, Chengdu (CN); Nan Zhang, Chengdu (CN); Yang Zhou, Chengdu (CN); Yang Chen, Chengdu (CN); Furong Wang, Chengdu (CN); Daoquan Fan, Chengdu (CN)

(73) Assignee: Southwestern Petroleum University, Chengdu (CN)

( * ) Notice: Subject to any disclaimer, the term of this patent is extended or adjusted under 35 U.S.C. 154(b) by 0 days.

(21) Appl. No.: 18/764,271

(22) Filed: Jul. 4, 2024

(65) Prior Publication Data

US 2024/0360746 A1 Oct. 31, 2024

Related U.S. Application Data

(63) Continuation-in-part of application No. 18/034,073, filed as application No. PCT/CN2021/132628 on Nov. 24, 2021, now abandoned.

(30) Foreign Application Priority Data

Sep. 8, 2021 (CN) ..... 202111048694.2

(51) Int. Cl.
*E21B 43/26* (2006.01)

(52) U.S. Cl.
CPC ..... *E21B 43/26* (2013.01)

(58) Field of Classification Search
None
See application file for complete search history.

(56) References Cited

U.S. PATENT DOCUMENTS 3,075,463 A * 1/1963 Eilers ..... E21B 43/263 166/299
2012/0302470 A1* 11/2012 Pollard ..... C09K 8/52 507/261
2012/0305247 A1* 12/2012 Chen ..... E21B 43/267 166/280.1

(Continued)

*Primary Examiner* — Anuradha Ahuja

(57) ABSTRACT

A shale gas formation oxidation induced rock burst stimulation method, the method including: performing hydraulic fracturing stimulation on a shale gas well to be fractured; and in the hydraulic fracturing process, injecting slick water A (f), oxidation fluid (e), slick water containing glue liquid (d), catalytic decomposition fluid (c), and slick water B (b) in a slug mode in sequence, and integrating shale physical characteristics and chemical thermodynamic properties to provide a fracturing fluid usage and the radius of the oxidation induced rock burst calculation formula. According to the method, the methane gas released by the shale gas formation after fracturing by the slick water A (f) is mixed with oxygen generated by the decomposition of hydrogen peroxide in the oxidation solution (e), and the shale gas formation is burst, such that the safe, efficient and damage-free multi-scale yield increasing stimulation of hydraulic fractures.

2 Claims, 2 Drawing Sheets

(56) References Cited

U.S. PATENT DOCUMENTS

| | | | | |
|---|---|---|---|---|
| 2013/0206400 | A1* | 8/2013 | Alexandrov | C09K 8/592<br>166/50 |
| 2014/0096958 | A1* | 4/2014 | Wernimont | E21B 43/16<br>166/268 |
| 2014/0262249 | A1* | 9/2014 | Willberg | E21B 43/247<br>166/259 |
| 2015/0252663 | A1* | 9/2015 | Stehle | C06B 23/009<br>166/299 |
| 2016/0152888 | A1* | 6/2016 | Alwattari | C09K 8/80<br>507/215 |
| 2021/0010359 | A1* | 1/2021 | Ruhle | G06N 20/00 |

* cited by examiner

SHALE GAS FORMATION OXIDATION INDUCED ROCK BURST STIMULATION METHOD

CROSS-REFERENCE TO RELATED APPLICATIONS

This application is a continuation-in-part of U.S. application Ser. No. 18/034,073. This application claims priorities from U.S. application Ser. No. 18/034,073, filed Apr. 27, 2023, PCT Application No. PCT/CN2021/132628, filed Nov. 24, 2021, and from the Chinese patent application 202111048694.2 filed Sep. 8, 2021, the content of which are incorporated herein in the entirety by reference.

TECHNICAL FIELD

The present invention relates to a new method of capacity increasing stimulation in the technical field of oil and natural gas exploitation, and particularly relates to a shale gas formation oxidation induced rock burst stimulation method.

BACKGROUND

Shale formations are generally characterized by dense matrix and strong heterogeneity. Matrix pore throats mainly include nano-scale organic pores and clay mineral intergranular pores. Matrix permeability mainly ranges from nanodarcy to microdarcy. Shale gas seepage resistance is huge, with the coexistence of adsorbed/free gas. Shale gas production needs a serial process of desorption-diffusion-seepage. However, the desorption-diffusion process of adsorbed gas in nanopores is slow, and the resistance of free gas diffusion-seepage is large, resulting in an extremely low shale gas transmission capacity. Therefore, an effective capacity increasing stimulation technology is required.

At present, multi-stage hydraulic fracturing of a horizontal well is the primary means for shale oil and gas reservoir stimulation. Firstly, hydraulic fracturing breaks the shale matrix and opens natural fractures, so that a complex artificial fracture network is formed inside the gas reservoir, thereby shortening the flow distance of gas seeping from matrix pores to fractures, increasing the discharge area, and realizing the economic development of shale gas formations. However, the recovery of shale gas formations is generally low, and the recovery of shale oil and gas reservoirs is much lower than that of conventional oil and gas reservoirs, accounting only about 10% to 16%. The recovery of shale gas formations in North America is generally 5% to 20%, especially in the Barnett area, the recovery is only about 10%. From the perspective of long-term development, enhancing recovery is an inevitable choice for shale oil and gas development.

In addition, although the fracture network formed by primary hydraulic fracturing is beneficial to improving the seepage capacity of shale gas formations, the problem of low desorption-diffusion transmission capacity of gas in the matrix pores at the distal end of fracture still cannot be solved, which causes the gas supply capacity of the shale matrix is far lower than the gas transmission capacity in the fracture. As a result, the production of gas wells in the early stage of exploitation decreases exponentially, the commercial exploitation period is shortened, the recovery is reduced, and the development cost is increased.

Analysis suggests that improving the production efficiency of methane in shale matrix is fundamentally to increase the diffusion rate of adsorbed gas and free gas. Due to the dense shale matrix, microfractures become the main channels for gas seepage. Thus, promoting the generation of microfractures to shorten the diffusion path of methane in nanopores is a main idea of hydraulic fracturing stimulation of shale gas formations. Studies have shown that, compared with hydraulically supported fractures, unsupported fractures formed by stress disturbance during fracturing have a larger area of contact with the shale matrix, control a wider range of seepage areas, and are very significant for delaying the rapid decline of shale gas well production. Therefore, on the basis of hydraulic fracturing, obtaining more unsupported fractures or secondary microfractures is one of the important breakthroughs to enhance fracturing stimulation effect and improve shale gas recovery.

SUMMARY

An objective of the present invention is to achieve the secondary stimulation of a shale gas formation by generating local burst in a fractured well segment based on the hydraulic fracturing technology in the prior art, so as to increase the fracture-making efficiency and the fracture density of the existing fracturing stimulation method and supplement and enhance the effect of the existing fracturing stimulation. In the present invention, slick water A, oxidation fluid, slick water and gel, catalytic decomposition fluid and slick water B are sequentially injected to an in-well fracturing liquid in a slug mode. Methane gas released by the shale gas formation after fracturing by the slick water A is mixed with oxygen generated by decomposition of hydrogen peroxide in the oxidation fluid, such that the safe, efficient and damage-free multi-scale yield increasing stimulation of hydraulic fractures, explosion fractures and corrosion apertures is achieved.

The specific technical solutions of the present invention are as follows:

A shale gas formation oxidation induced rock burst stimulation method, including:

performing a hydraulic fracturing stimulation on a shale gas well to be fractured; and in the hydraulic fracturing process, injecting slick water A, oxidation fluid, slick water and gel, catalytic decomposition fluid, and slick water B in a slug mode in sequence.

The slick water A is mainly used for making fractures by hydraulic fracturing and promoting the release of methane gas in the shale matrix into hydraulic fractures.

The oxidation fluid is a mixture of hydrogen peroxide and dilute hydrochloric acid, where the hydrogen peroxide is used to produce oxygen through decomposition after entering the hydraulic fractures, and the dilute hydrochloric acid is used to prevent the decomposition of the hydrogen peroxide in a wellbore.

The amount of the slick water and gel injected must be greater than the effective volume of the wellbore, which ensures the hydrogen peroxide in the wellbore to totally enter fractures and prevents a catalytic decomposition agent in the catalytic decomposition fluid from reacting in advance with the hydrogen peroxide in the oxidation fluid in the wellbore.

The catalytic decomposition fluid uses slick water containing a catalytic decomposition agent, and is used to catalyze the decomposition of hydrogen peroxide in the hydraulic fractures. The catalytic decomposition agent includes, but is not limited to, sodium hydroxide and manganese dioxide.

The slick water B seals and isolates the oxidation fluid, which makes the local burst in shale hydraulic fractures occur away from the end of the wellbore and protects the integrity of the wellbore.

As a preferred technical solution, the amount of the slick water A injected is calculated according to the following formula:

$$V_1 = \alpha\left(2LHW + \frac{(D-2\delta)^2}{4}\pi h\right)$$

Where $V_1$ represents a volume of the slick water A; $\alpha$ represents a leakage coefficient, set as 1.0-1.5; D represents an outer diameter of a casing; $\delta$ represents a wall thickness of the casing; h represents a well depth; L represents a burst point depth; H represents a height of a major fracture of hydraulic fracturing; and W represents a width of the major fracture of hydraulic fracturing.

As a preferred technical solution, the oxidation fluid is a mixture of hydrogen peroxide and dilute hydrochloric acid.

As a preferred technical solution, the mass of hydrogen peroxide injected or the radius of the oxidation induced rock burst is calculated according to the following formula:

$$2\phi\pi r^3(P_O + \sigma) = Z_m R\left(\frac{2P_o\phi\pi r^3}{Z_o RT_o} + \frac{m}{2M_{H2O2}}\right)\left(\frac{16qm}{136CM_{CH4}\left(\frac{2P_o\phi\pi r^3}{Z_o RT_o} + \frac{m}{2M_{H2O2}}\right)} + T_o\right)$$

Where $P_o$ represents an original formation pressure; $\sigma$ represents a tensile strength of shale; $\phi$ represents a porosity of shale; r represents the radius of the oxidation induced rock burst; R represents an ideal gas constant; $Z_o$ represents a gas compression factor before oxidation induced rock burst; $Z_m$ represents a gas compression factor after oxidation induced rock burst; $T_o$ represents an original formation temperature, K; m represents a mass of hydrogen peroxide injected; $M_{H2O2}$ represents a molar mass of hydrogen peroxide; $M_{CH4}$ represents a molar mass of methane; C represents a specific heat capacity of methane; and q represents a calorific value of methane when the product is gaseous water.

As a preferred technical solution, according to the calculation formula of the mass of hydrogen peroxide injected or the radius of the oxidation induced rock burst, the mass m of hydrogen peroxide injected is given to yield the one-dimensional higher-order equation of the radius r of oxidation induced rock burst. The one-dimensional higher-order equation of the radius r of oxidation induced rock burst is solved to obtain the radius r of oxidation induced rock burst.

Alternatively, according to the calculation formula of the mass of hydrogen peroxide injected or the radius of the oxidation induced rock burst, the radius r of oxidation induced rock burst is given to yield the one-dimensional higher-order equation of the mass m of hydrogen peroxide injected. The one-dimensional higher-order equation of the mass m of hydrogen peroxide injected is solved to obtain the mass m of hydrogen peroxide injected.

As a preferred technical solution, the amount of the slick water and gel injected is greater than the effective volume of the wellbore.

As a preferred technical solution, the amount of the slick water and gel injected is calculated according to the following formula:

$$V_2 = \beta\frac{(D-2\delta)^2}{4}\pi h$$

Where $V_2$ represents a volume of the slick water and gel; $\beta$ represents a safety factor, set as 1.0-1.5. D represents an outer diameter of a casing; $\delta$ represents a wall thickness of the casing; and h represents a well depth.

As a preferred technical solution, the catalytic decomposition fluid is prepared by adding a catalytic decomposition agent into slick water. The catalytic decomposition agent includes, but is not limited to, sodium hydroxide and manganese dioxide.

As a preferred technical solution, the amount of the catalytic decomposition fluid injected is calculated according to the following formula:

$$V_4 = \frac{m}{0.2\rho}$$

Where $V_4$ represents a volume of the catalytic decomposition fluid; $\rho$ represents a density of the slick water; and m represents a mass of hydrogen peroxide injected.

As a preferred technical solution, the slick water B is used to seal and isolate the oxidation fluid, which makes the local burst in shale hydraulic fractures occur away from the end of the wellbore and protects the integrity of the wellbore.

The amount of the slick water B injected is calculated according to the following formula:

$$V_5 = 2LHW + \frac{(D-2\delta)^2}{4}\pi h$$

Where $V_5$ represents a volume of the slick water B; D represents an outer diameter of a casing; $\delta$ represents a wall thickness of the casing; h represents a well depth; L represents a burst point depth; H represents a height of a major fracture of hydraulic fracturing; and W represents a width of the major fracture of hydraulic fracturing.

In the technical solution of the present invention:

The term "tensile strength", also known as a strength of extension, is referenced in the following literature: Schon, J. H. Physical Properties of Rocks: A Workbook [M]. Elsevier; Elsevier Science & Technology [Distributor],2011; Li Haibin, et al. "Controlling mechanism of shale palaeoenvironment on its tensile strength: A case study of Banjiuguan Formation in Micangshan Mountain." Fuel 355.(2024); Zhang, Xiaoping; Zhang, Peiyuan; Ji, Peiqi; Zhang, Han; Zhang, Qi. "The Applicability of Brazilian Test Loading with Different Platens to Measure Tensile Strength of Rock: A Numerical Study." ROCK MECHANICS AND ROCK ENGINEERING 57.1(2024):233-260.

The term "shale" is referenced in the following literature: Schon, J. H. Physical Properties of Rocks: A Workbook [M]. Elsevier; Elsevier Science & Technology [Distributor], 2011.

The term "porosity" is referenced in the following literature: Schon, J. H. Physical Properties of Rocks: A Workbook [M]. Elsevier; Elsevier Science & Technology [Distributor], 2011.

The term "shale gas formation" is referenced in the following literature: Schon, J. H. Physical Properties of Rocks: A Workbook [M]. Elsevier; Elsevier Science & Technology [Distributor],2011; Or Aimon Brou Koffi Kablan; Tongjun Chen. "Petrophysical properties identification and estimation of the Wufeng-Longmaxi shale gas reservoirs: a case study from South-West China." Journal of Geophysics and Engineering 21.1(2024):15-28.

The advantages are as follows:

(1) The density and complexity of fracture network are increased. Artificial fractures are formed by hydraulic fracturing, and the fracture density and depth are further enhanced through oxidation induced rock burst, thereby forming a denser spherical fracture network.

(2) The construction operations are convenient and safe. In the process of hydraulic fracturing, the injection into a reservoir is conducted in a slug mode along with conventional fracturing liquid, and a reasonable amount of the fracturing liquid injected makes oxidation induced rock burst occur in hydraulic fractures far away from the wellbore.

(3) The chemical energy is fully utilized and the economic cost is low. Considering the combined action of combustible gas explosion generating high temperature and high pressure, the range of oxidation induced rock burst is calculated to provide guidance for process implementation. At the same time, the hydrogen peroxide solution is widely used in many stages of oil exploration and development, the price of which is relatively low, effectively controlling the economic cost of fracturing stimulation.

(4) In the present invention, oxygen is generated by the decomposition of hydrogen peroxide to induce local methane explosion in fractures of a reservoir, further stimulating the shale gas formation. The method of the present invention is established based on an existing hydraulic fracturing shale gas well without additional drilling, and the required energy derives from hydrocarbon gas and oxygen produced by the decomposition of hydrogen peroxide in the reservoir, which reduces the cost of shale oil and gas exploitation and further improves the effect of hydraulic fracturing stimulation. When the scale of hydraulic fracturing is the same, oxidation induced rock burst and hydraulic fracturing stimulation will be conductive to increasing the stimulated reservoir volume (SRV). For deeper shale gas formations (≥3500 m), in the case of poor hydraulic fracturing effect, the present invention provides a new idea for the effective development of deep shale gas.

(5) In the present invention, oxygen is generated by the decomposition of hydrogen peroxide and mixed with methane, and oxidation induced rock burst is formed after self-igniting at high temperature and high pressure of the formation. In the prior art, aluminum powder and metallic oxides in thermite may block reservoir pores and fractures, and reduce rock permeability. Therefore, in the present invention, the hydrogen peroxide solution is injected, which will not block fractures or pores, but will protect the reservoir.

(6) The working fluid of the present invention mainly includes hydrogen peroxide, sodium hydroxide or manganese dioxide, where manganese dioxide serves as a catalyst, and hydrogen peroxide is catalyzed and decomposed to release oxygen. In the present invention, oxygen is mixed with methane in the reservoir, and the mixture self-ignites at high temperature and high pressure to create fractures. The manganese dioxide of the present invention, as a catalyst, is not consumed by the reaction, so that less manganese dioxide is needed to meet the demand. The present invention provides a new method for creating fractures through oxidation induced rock burst, specifically including: the combustible gas methane in the shale gas formation can self-ignite in the presence of oxygen at high temperature and high pressure to create fractures.

(7) In the present invention, a mathematical equation is constructed based on rock mechanics and chemical thermodynamics and solved to obtain the specific working fluid usage or fracturing volume in the oxidation induced rock burst process. The fracture calculation method provided in the present invention is consistent with the oxidation induced rock burst method.

(8) In the present disclosure, the purpose of injecting slick water A, oxidation fluid, slick water and gel, catalytic decomposition fluid, and slick water B in sequence is as follows: firstly, the slick water A is used to create hydraulic fractures, which provides space for the subsequent injection of working fluid into the formation, while methane gas in the shale matrix will be diffused and transferred to the fractures, which provides fuel for combustion; In addition, the oxidation fluid is a mixture of hydrogen peroxide and dilute hydrochloric acid, which has relatively stable properties, delays decomposition and provides a source of oxygen; thirdly, the slick water and gel contains polyacrylamide, which acts as a thickener with high viscosity, and presses the oxidation fluid into the hydraulic fractures as the displacing liquid to avoid contact between the subsequently injected catalytic decomposition fluid and the oxidation fluid in the wellbore; fourthly, the catalytic decomposition fluid, after entering the hydraulic fractures, is mixed with the oxidation fluid through liquid diffusion, manganese dioxide or sodium hydroxide catalyzes the decomposition of hydrogen peroxide to produce oxygen and a combustion enhancer needed for combustion, and the mixture of methane and oxygen can self-ignite after reaching the theoretical explosion limit at high temperature and high pressure in the shale reservoir; and fifthly, the slick water B displaces the previous four kinds of fluids into the hydraulic fractures, to keep the oxidation induced rock burst away from the wellbore. Injecting in a slug mode in sequence has multiple effects, including: combustible methane is released under in-situ conditions, the combustion enhancer oxygen is efficiently provided to the hydraulic fractures of shale, accidents of combustion and explosion near the wellbores or boreholes are avoided, and procedures are simplified without need for downhole ignition devices.

BRIEF DESCRIPTION OF THE DRAWINGS

In order to illustrate the specific embodiments of the present invention or the technical solutions in the prior art more clearly, a brief introduction of the accompanying drawings that are required to be used in the description of the specific embodiments or the prior art will be present below. In all figures, similar elements or parts are generally identified by similar reference numerals. In the drawings, each element or part is not necessarily drawn to actual scale.

In the figures, a—shale gas formation; b—slick water B; c—catalytic decomposition fluid; d—slick water and gel; e—oxidation fluid; f—slick water A; g—bridge plug; h—horizontal well; i—major fracture of hydraulic fracturing; j—oxidation fluid and catalytic decomposition fluid; k—fracture network formed by oxidation induced rock burst.

DETAILED DESCRIPTION OF THE EMBODIMENTS

The technical solutions in the embodiments of the present invention will be clearly and completely described below. Obviously, the described embodiments are only a part of the embodiments of the present invention, rather than all the embodiments. Based on the embodiments of the present invention, all other embodiments obtained by those of ordinary skill in the art without creative efforts shall fall within the scope of protection of the present invention.

It should be noted that, all directional indications (such as up, down, left, right, front, back . . . ) in the embodiments of the present invention are only used to explain the relative positional relationship, movement situation, etc. of various elements under a specific posture (as shown in the accompanying drawings). If the specific posture changes, the directional indications also change accordingly.

In addition, expressions such as "first", "second", etc. involved in the present invention are only for the purpose of description, and should not be construed as indicating or implying relative importance thereof or implicitly indicating the number of the technical features referred. Thus, features defined by "first" and "second" may expressly or implicitly include at least one of the features. In the description of the present invention, "plurality" means at least two, such as two, three, etc., unless otherwise expressly and specifically defined.

In order to make the objectives, technical solutions, and advantages of the present invention clearer, the present invention will be further described in detail below with reference to the accompanying drawings and embodiments. It should be understood that the specific embodiments described herein are only used to explain the present invention, but not to limit the invention.

The present invention is now further described with reference to the accompanying drawings.

Figure 1:
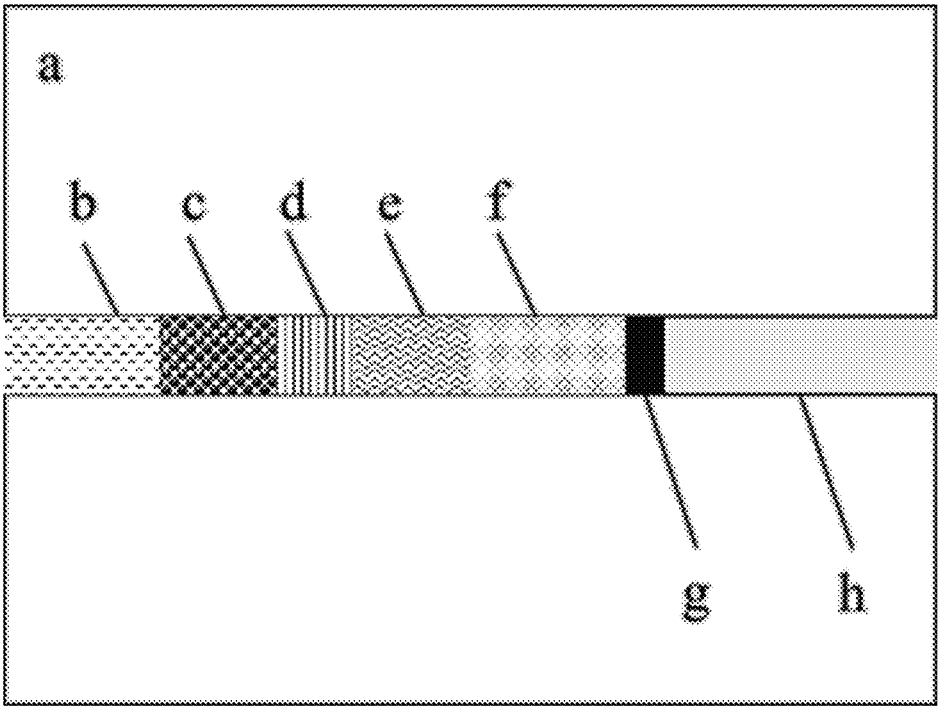
FIG. 1 is a schematic diagram showing the inflow of working fluid in a multi-stage hydraulic fracturing process of a horizontal well in a shale gas formation according to an embodiment of the present invention.
Figure 2:
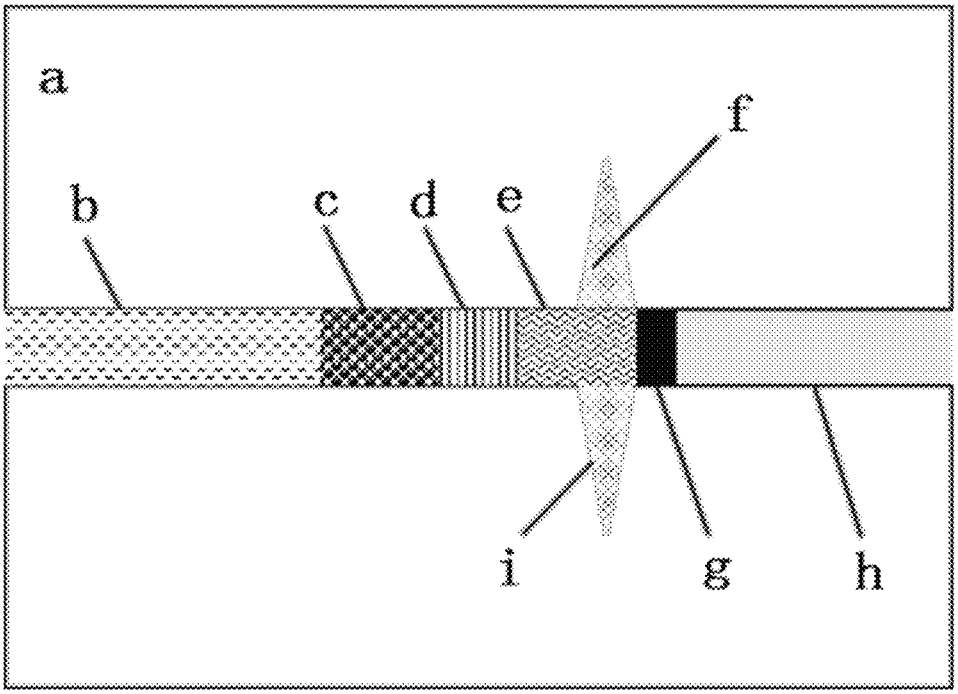
FIG. 2 is a schematic diagram showing the process of the inflow of fracturing liquid and the generation of oxygen after a first-stage hydraulic fracturing according to an embodiment of the present invention.
Figure 3:
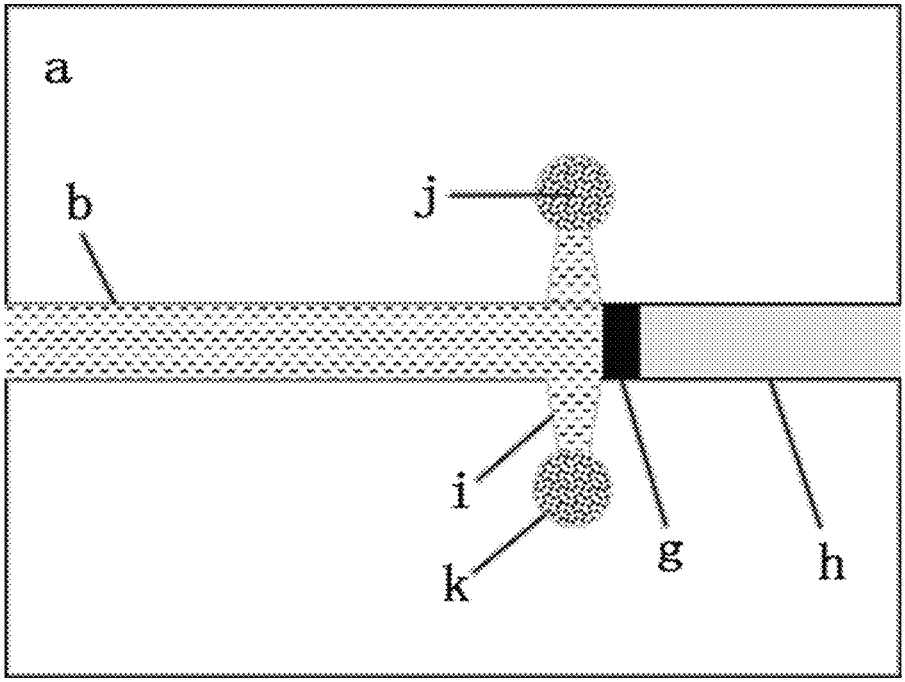
FIG. 3 is a schematic diagram showing the first-stage shale gas formation stimulation by oxidation induced rock burst according to an embodiment of the present invention.

As shown in FIG. 1, a horizontal well of a shale gas formation is subjected to a hydraulic fracturing stimulation based on the present invention. An in-well working fluid is injected in sequence in a slug mode. The slick water A (f in FIG. 1) is pumped in the early stage for the hydraulic fracturing stimulation (FIG. 2), which creates conditions for the full contact of the subsequently injected oxidation fluid (e in FIG. 2) and catalytic decomposition fluid (c in FIG. 2) in artificial fractures. The slick water and gel (d in FIG. 2) is used to separate the oxidation fluid from the catalytic decomposition fluid in a wellbore. Subsequently, the slick water B (b in FIG. 3) is pumped to drive the oxidation fluid into interior of the fractures, making the point of oxidation induced rock burst away from the wellbore. Considering the pump pressure during fracturing, the methane content in the artificial fractures is constant. When the amount of oxygen generated by the catalytic decomposition of a hydrogen peroxide solution reaches the range required for oxidation induced shale rock burst, the mixed gas of methane and oxygen deflagrates at high temperature and high pressure to fracture the shale matrix, resulting in the generation of a fracture network caused by rock burst (K in FIG. 3) and realizing the secondary stimulation of reservoir.

There are differences in the explosion limit of methane when the methane is mixed with different gases. At normal temperature and normal pressure, the explosion limit of methane in air is about 5%-15%; the explosion limit of methane in pure oxygen is about 5.0%-61%. High temperature and high pressure lead to more violent molecular thermal motion. The explosion limit of a methane-air mixture is 2.87%-64.40% at 20 MPa and 100° C., and the critical oxygen content of explosion theoretically can be reduced to 5.74%. Therefore, the amount of hydrogen peroxide injected can be adjusted to achieve the proportion required for methane explosion.

In the embodiment of the present invention, a deep shale gas well of the Longmaxi Formation in the Sichuan Basin is taken as an example for calculating the amount of a fracturing liquid required for oxidation induced rock burst.

(1) Slick Water A

The amount of the slick water A used is determined according to the position of burst point and the morphology of hydraulic fracture and adjusted according to small-scale fracturing test.

$$V_1 = \alpha\left(2LHW + \frac{(D-2\delta)^2}{4}\pi h\right)$$

Where $V_1$ represents a volume of the slick water A, $m^3$; $\alpha$ represents a leakage coefficient, set as 1.0-1.5; D represents an outer diameter of a casing, m; $\delta$ represents a wall thickness of the casing, m; h represents a well depth, m; L represents a burst point depth, m; H represents a height of a major fracture of hydraulic fracturing, m; and W represents a width of the major fracture of hydraulic fracturing, m.

The casing has an outer diameter of 139.7 mm and a wall thickness of 12.7 mm. The well depth is 5100 m. The first burst point depth is 70 m. The major fracture of hydraulic fracturing has a height of 20 m and a width of 0.03 m. The amount of the slick water A used is 164 $m^3$.

(2) Oxidation Fluid and Range of Oxidation Induced Rock Burst

The oxidation fluid is a mixture of hydrogen peroxide and dilute hydrochloric acid (the mass concentration of the hydrogen peroxide is 20%). The occurrence of oxidation induced rock burst depends on two reactions including the decomposition of hydrogen peroxide to generate oxygen and the combustion of oxygen and methane mixed. The mass of the hydrogen peroxide injected determines the range involved, that is, the radius of a fracture network formed by oxidation induced rock burst. The maximum explosion pressure generated in the explosion of mixture can be determined according to the relationship that pressure is directly proportional to thermodynamic temperature and mole number. The mass of hydrogen peroxide injected or the range of oxidation induced rock burst are calculated as follows:

$$2\phi\pi r^3(P_O+\sigma) = Z_m R\left(\frac{2P_o\phi\pi r^3}{Z_o RT_o} + \frac{m}{2M_{H2O2}}\right)\left(\frac{16qm}{136CM_{CH4}\left(\frac{2P_o\phi\pi r^3}{Z_o RT_o} + \frac{m}{2M_{H2O2}}\right)} + T_o\right)$$

Where $P_o$ represents an original formation pressure, Pa; σ represents a tensile strength of shale, Pa; ϕ represents a porosity of shale; r represents the radius of the oxidation induced rock burst, m; R represents an ideal gas constant, 8.314 J $mol^{-1} \cdot K^{-1}$; $Z_o$ represents a gas compression factor before oxidation induced rock burst; $Z_m$ represents a gas compression factor after oxidation induced rock burst; $T_o$ represents an original formation temperature, K; m represents a mass of hydrogen peroxide injected, g; $M_{H2O2}$ represents a molar mass of hydrogen peroxide, 34 g/mol; $M_{CH4}$ represents a molar mass of methane, 16 g/mol; C represents a specific heat capacity of methane, 2.227 KJ/(kg·K); and q represents a calorific value of methane when the product is gaseous water, 50200 KJ/kg.

According to the above formula, m is given to yield the one-dimensional higher-order equation of r, which is solved by a bisection method.

In the example, the original formation pressure is 66.8 MPa, the tensile strength of shale after hydration is 6.3 MPa, the original formation temperature is 393 K, the average porosity is 4.17%, the gas compression factors before and after oxidation induced rock burst are both 1.2, the amount of oxidation fluid used is 5000 kg (hydrogen peroxide is 1000 kg), and the radius of the oxidation induced rock burst is 8.5 m.

(3) Slick Water and Gel

The slick water and gel is used to press the oxidation fluid from the wellbore into the formation to prevent the reaction of hydrogen peroxide and catalyst in the wellbore, and the amount used is 1.2 times the volume of the wellbore.

$$V_2 = \beta \frac{(D-2\delta)^2}{4}\pi h$$

Where $V_2$ represents a volume of the slick water and gel, $m^3$; and β represents a safety factor, set as 1.0-1.5.

The parameters are the same as those of the slick water A, and the amount of the slick water and gel used is 63 $m^3$.

(4) Catalytic Decomposition Fluid

The catalytic decomposition fluid uses slick water containing a catalytic decomposition agent, with a volume being the same as that of the oxidation fluid. The catalytic decomposition agent includes, but is not limited to, sodium hydroxide and manganese dioxide.

$$V_4 = \frac{m}{0.2\rho}$$

Where $V_4$ represents a volume of the catalytic decomposition fluid, $m^3$; and ρ represents a density of the slick water, $kg/m^3$.

The density of the slick water is 1000 $kg/m^3$, and the amount of the catalytic decomposition fluid used is 5 $m^3$.

(5) Slick Water B

The slick water B is used to drive hydrogen peroxide and catalyst into the interior of fractures to avoid the wellbore being affected by oxidation induced rock burst and protect the integrity of the wellbore.

$$V_5 = 2LHW + \frac{(D-2\delta)^2}{4}\pi h$$

Where $V_5$ represents a volume of the slick water B, $m^3$.

Other parameters are the same as those of the slick water A, and the amount of the slick water B used is 136 $m^3$.

According to the calculation method provided by the present invention, the total fracturing fluid usage in oxidation induced rock burst is 373 $m^3$, and a fracture network caused by oxidation induced rock burst is generated at a location 70 m from each of two wings of the wellbore, with the radius of the fracture network being 8.5 m.

In some embodiments, the slick water and gel includes a drag reducer, a surfactant, a clay stabilizer, a bactericidal agent, polyacrylamide, and water.

In some embodiments, the slick water and gel includes the following parts in percentage by weight: 0.2%-0.4% of the drag reducer, which specifically may be 0.2%, 0.25%, 0.3%, 0.35%, 0.4%, and the like; 0.2%-0.4% of the surfactant, which specifically may be 0.2%, 0.25%, 0.3%, 0.35%, 0.4%, and the like; 0.3%-0.6% of the clay stabilizer, which specifically may be 0.3%, 0.4%, 0.5%, 0.6%, and the like; 0.1%-0.2% of the bactericidal agent, which specifically may be 0.1%, 0.15%, 0.2%, and the like; 0.2%-0.4% of the polyacrylamide, which specifically may be 0.2%, 0.25%, 0.3%, 0.35%, 0.4%, and the like; and a balance of water.

In some embodiments, the drag reducer comprises one of polyethylene glycol and hydroxypropyl guar gum, or a combination thereof.

In some embodiments, the surfactant comprises one of sodium stearate and potassium stearate, or a combination thereof.

In some embodiments, the clay stabilizer comprises one of potassium chloride and sodium chloride, or a combination thereof.

In some embodiments, the bactericidal agent comprises one of ammonium chloride and polylysine, or a combination thereof.

In some embodiments, the water is tap water or clean water.

Example 1 of Slick Water and Gel

The slick water and gel includes the following parts in percentage by weight: 0.3% of polyethylene glycol, 0.3% of Sodium stearate, 0.45% of potassium chloride, 0.15% of ammonium chloride, 0.3% of polyacrylamide, and 98.5% of tap water.

Example 2 of Slick Water and Gel

The slick water and gel includes the following parts in percentage by weight: 0.2% of hydroxypropyl guar gum, 0.2% of Potassium stearate, 0.3% of sodium chloride, 0.1% of polylysine, 0.2% of polyacrylamide, and 99% of clean water.

Example 3 of Slick Water and Gel

The slick water and gel includes the following parts in percentage by weight: 0.4% of polyethylene glycol, 0.4% of Potassium stearate, 0.6% of sodium chloride, 0.2% of ammonium chloride, 0.4% of polyacrylamide, and 98% of tap water.

In the technical solution of the present invention, the slick water and gel used is that made according to a formula of Example 1.

In some embodiments, the slick water A comprises a drag reducer, a clay stabilizer, a bactericidal agent, and water.

In some embodiments, the slick water A comprises the following parts in percentage by weight: 0.2%-0.4% of the drag reducer; 0.3%-0.6% of the clay stabilizer; 0.1%-0.2% of the bactericidal agent; and a balance of water.

In some embodiments, the drag reducer comprises one of polyethylene glycol and hydroxypropyl guar gum, or a combination thereof.

In some embodiments, the clay stabilizer comprises one of potassium chloride and sodium chloride, or a combination thereof.

In some embodiments, the bactericidal agent comprises one of ammonium chloride and polylysine, or a combination thereof.

In some embodiments, the water is tap water or clean water.

Example 1 of Slick Water A

The slick water A includes the following parts in percentage by weight: 0.3% of polyethylene glycol, 0.45% of potassium chloride, 0.15% of ammonium chloride, the water is tap water, 99.1% of tap water.

Example 2 of Slick Water A

The slick water A includes the following parts in percentage by weight: 0.2% of hydroxypropyl guar gum, 0.3% of sodium chloride, 0.1% of polylysine, the water is clean water, 99.5% of clean water.

Example 3 of Slick Water A

The slick water A includes the following parts in percentage by weight: 0.4% of polyethylene glycol, 0.6% of sodium chloride, 0.2% of ammonium chloride, the water is tap water, 98.8% of tap water.

In the technical solution of the present invention, the slick water A used is that made according to a formula of Example 1.

The slick water B is the same as the slick water A.

In the technical solution of the present invention, The formulation of the slick water B used is as follows: The slick water B includes the following parts in percentage by weight: 0.3% of polyethylene glycol, 0.45% of potassium chloride, 0.15% of ammonium chloride, the water is tap water, 99.1% of tap water.

The above embodiments are only used to illustrate the technical solutions of the present invention, rather than to limit the invention. Although the present invention has been described in detail with reference to the foregoing embodiments, those of ordinary skill in the art should understand that the technical solutions recited in the foregoing embodiments can still be modified, or some or all of the technical features thereof can be equivalently replaced. These modifications or replacements do not make the essence of the corresponding technical solutions deviate from the scope of the technical solutions of the embodiments of the present invention, all of which should be included within the scope of the claims and specification of the present invention.

The invention claimed is:

1. A shale gas formation oxidation induced rock burst stimulation method, the method comprising:

performing a hydraulic fracturing stimulation on a shale gas reservoir through a well comprising a wellbore with casing;

the hydraulic fracturing stimulation comprising:

sequentially injecting (i) slick water A, (ii) an oxidation fluid, (iii) slick water and gel, (iv) a catalytic decomposition fluid, and then (v) slick water B into the reservoir through the wellbore of the well, wherein the injecting is configured to produce an oxidation induced rock burst to generate secondary microfractures by stress disturbance during the hydraulic fracturing stimulation;

the injecting comprising:

(a) pumping the slick water A for a first stimulation of the reservoir thereby opening natural fractures and yielding artificial fractures, which creates conditions for contact of the subsequently injected oxidation fluid and catalytic decomposition fluid with the artificial fractures;

(b) pumping the slick water and gel to separate the oxidation fluid from the catalytic decomposition fluid in the wellbore;

(c) pumping the slick water B to drive the oxidation fluid into interior of the artificial fractures, and thereby producing the oxidation induced rock burst away from the wellbore;

wherein, with a fixed pump pressure, an amount of methane in the artificial fractures is constant;

wherein oxygen generated by the catalytic decomposition fluid reaches a range required for the oxidation induced rock burst, and a mixed gas of the methane and the oxygen combust at a temperature and a pressure to fracture a shale matrix of the reservoir, thereby generating a fracture network caused by the rock burst and realizing a second stimulation of the reservoir;

wherein a volume of the slick water A injected is calculated according to the following formula (1):

$$V_1 = \alpha\left(2LHW + \frac{(D-2\delta)^2}{4}\pi h\right) \quad (1)$$

where $V_1$ represents the volume of the slick water A; $\alpha$ represents a leakage coefficient, set as 1.0-1.5; D represents an outer diameter of the casing; $\delta$ represents a wall thickness of the casing; h represents a depth of the well; L represents a location depth of the rock burst; H represents a height of a major fracture of the artificial fractures; and W represents a width of the major fracture of the artificial fractures, and wherein a volume of the slick water and gel injected is greater than an effective volume of the wellbore of the well, and the volume of the slick water and gel injected is configured to ensure the oxidation fluid fully enters the artificial fractures and to prevent a catalytic decomposition agent in the catalytic decomposition fluid from reacting with the oxidation fluid in the wellbore;

wherein the oxidation fluid is a mixture of hydrogen peroxide and hydrochloric acid:

wherein the oxidation induced rock burst occurs from two reactions including a decomposition of the hydrogen peroxide to generate the oxygen and the combustion of the mixed gas of the oxygen and the methane;

wherein a mass of the hydrogen peroxide injected is known and a radius of the oxidation induced rock burst is calculated according to the following formula (2) or the radius of the oxidation induced rock burst is known and the mass of the hydrogen peroxide injected is calculated according to the following formula (2):

$$2\phi\pi r^3(P_O+\sigma)=Z_mR\left(\frac{2P_o\phi\pi r^3}{Z_oRT_o}+\frac{m}{2M_{H2O2}}\right)\left(\frac{16qm}{136CM_{CH4}\left(\frac{2P_o\phi\pi r^3}{Z_oRT_o}+\frac{m}{2M_{H2O2}}\right)}+T_o\right) \quad (2)$$

where $P_o$ represents an original pressure of the reservoir; σ represents a tensile strength of the shale: ϕ represents a porosity of the shale: r represents the radius of the oxidation induced rock burst; R represents an ideal gas constant; $Z_o$ represents a gas compression factor before the oxidation induced rock burst; $Z_m$ represents a gas compression factor after the oxidation induced rock burst; $T_o$ represents an original temperature of the reservoir in K; m represents the mass of the hydrogen peroxide injected; $M_{H2O2}$ represents a molar mass of the hydrogen peroxide; $M_{CH4}$ represents a molar mass of the methane; C represents a specific heat capacity of the methane; and q represents a calorific value of the methane;

wherein the volume of the slick water and gel injected is calculated according to the following formula (3):

$$V_2=\beta\frac{(D-2\delta)^2}{4}\pi h \quad (3)$$

where $V_2$ represents the volume of the slick water and gel; β represents a safety factor, set as 1.0-1.5; D represents the outer diameter of the casing; δ represents the wall thickness of the casing: and h represents the depth of the well;

wherein the catalytic decomposition fluid comprises slick water containing the catalytic decomposition agent, with a volume of the catalytic decomposition fluid being the same as that of the oxidation fluid; and the catalytic decomposition agent includes sodium hydroxide and manganese dioxide; the volume of the catalytic decomposition fluid injected is calculated according to the following formula (4):

$$V_4=\frac{m}{0.2\rho} \quad (4)$$

where $V_4$ represents the volume of the catalytic decomposition fluid: ρ represents a density of the slick water containing the catalytic decomposition agent; and m represents the mass of the hydrogen peroxide injected;

wherein the slick water B seals and isolates the oxidation fluid to make the rock burst in the artificial fractures occur away from an end of the wellbore and protect an integrity of the wellbore;

a volume of the slick water B injected is calculated according to the following formula (5):

$$V_5=2LHW+\frac{(D-2\delta)^2}{4}\pi h \quad (5)$$

where $V_5$ represents the volume of the slick water B; D represents the outer diameter of the casing: δ represents the wall thickness of the casing; h represents the depth of the well; L represents the location depth of the rock burst; H represents the height of the major fracture of the artificial fractures; and W represents the width of the major fracture of the artificial fractures;

wherein the slick water and gel comprises a drag reducer, a surfactant, a clay stabilizer, a bactericidal agent, polyacrylamide, and water;

wherein the slick water A includes in percentage by weight: 0.3% of polyethylene glycol, 0.45% of potassium chloride, 0.15% of ammonium chloride, and 99.1% of tap water;

wherein the slick water and gel includes in percentage by weight: 0.2%-0.4% of the drag reducer, 0.2%-0.4% of the surfactant, 0.3%-0.6% of the clay stabilizer, 0.1%-0.2% of the bactericidal agent, 0.2%-0.4% of the polyacrylamide, and a balance of the water;

wherein the drag reducer comprises one of polyethylene glycol, hydroxypropyl guar gum, or a combination thereof;

wherein the surfactant comprises one of sodium stearate, potassium stearate, or a combination thereof:

wherein the clay stabilizer comprises one of potassium chloride, sodium chloride, or a combination thereof;

wherein the bactericidal agent comprises one of ammonium chloride, polylysine, or a combination thereof; and wherein the slick water B includes in percentage by weight: 0.3% of polyethylene glycol, 0.45% of potassium chloride, 0.15% of ammonium chloride, and 99.1% of tap water.

2. The method of claim 1, wherein the outer diameter of the casing is 139.7 mm and the wall thickness of the casing is 12.7 mm;

the depth of the well is 5100 m; the location depth of the rock burst is 70 m;

the height of the major fracture is 20 m and the width of the major fracture is 0.03 m;

the volume of the slick water A injected is 164 $m^3$;

the original pressure is 66.8 MPa, the tensile strength of the shale is 6.3 MPa, the original temperature is 393 K, the porosity of the shale is 4.17%, the gas compression factors before and after the oxidation induced rock burst are both 1.2, the mass of the hydrogen peroxide injected is 1000 kg, and the radius of the oxidation induced rock burst is 8.5 m;

the volume of the slick water and gel injected is 63 $m^3$;

the density of the slick water is 1000 $kg/m^3$, and the volume of the catalytic decomposition fluid injected is 5 $m^3$.

* * * * *